US005173132A

United States Patent [19]

Solomon

[11] Patent Number: 5,173,132

[45] Date of Patent: Dec. 22, 1992

[54] GOLD SPRING ALLOY COMPOSITION

[75] Inventor: Louis P. Solomon, Stratford, Conn.

[73] Assignee: Handy & Harman, Fairfield, Conn.

[21] Appl. No.: 678,917

[22] Filed: Apr. 1, 1991

[51] Int. Cl.[5] ..... C22C 5/02

[52] U.S. Cl. ..... 148/405; 148/678; 420/511

[58] Field of Search ..... 148/405, 430, 158, 678; 420/511

[56] References Cited

U.S. PATENT DOCUMENTS

| | | | |
|---|---|---|---|
| 1,652,740 | 12/1927 | Shields | 420/511 |
| 1,917,378 | 7/1933 | Lenfant | 420/511 |
| 2,071,216 | 7/1935 | Powell et al. | 148/32 |
| 2,169,592 | 8/1939 | Peterson | 75/165 |
| 2,576,738 | 11/1951 | Williams | 420/481 |
| 2,842,825 | 7/1958 | Bangs | 24/252 |
| 3,141,799 | 8/1958 | Brellier et al. | 148/11.5 |
| 4,257,241 | 3/1981 | Voccio et al. | 63/14 D |

FOREIGN PATENT DOCUMENTS 59-157237 9/1984 Japan .
63-259042 10/1988 Japan .

OTHER PUBLICATIONS

Allen S. McDonald and George H. Sistare. "The Mettallurgy of Some Carat Gold Jewellery Alloys", *Gold Bulletin*, Jul. 1978, vol. 11, No. 3, pp. 66–73.

*Primary Examiner*—R. Dean
*Assistant Examiner*—Margery S. Phipps
*Attorney, Agent, or Firm*—Pennie & Edmonds

[57] ABSTRACT

This invention concerns a new spring gold alloy and heat treatment process specific to the new gold spring alloy. The heat treatment process and gold spring alloy are specifically formulated to work synergistically so as to optimize the ductility of the alloy after a first step, and resistance to deformation of the alloy after a second step of the heat treatment process.

16 Claims, 4 Drawing Sheets

GOLD SPRING ALLOY COMPOSITION

TECHNICAL FIELD

This invention is concerned with the field of metallurgy involving gold alloys suitable for use as spring members in jewelry as well as other applications.

BACKGROUND OF THE INVENTION

In the jewelry industry, as well as other industries requiring precision manufactured, resilient parts, there has been a need for a gold alloy that can provide at one stage of manufacture, a highly ductile workable form, and at a second stage, deformation resistance and superior memory properties necessary to retain or return to an original shape. This is a quality especially desirable in the manufacture of springs and clasps for jewelry.

In the past, gold alloy hardness and ductility have been controlled by altering the weight percentage of silver, gold, as well as other components utilized in formulating such alloys. Grain refining components such as cobalt have been utilized in order to decrease crazing and fracture which may occur during alloy manipulation. In addition, heat treatment processes which include an annealing step to provide increased ductility, followed by an age hardening step to provide increased rigidity to gold alloys, have been utilized.

Although heat treatment processing has been useful, there has been a need to formulate a specific gold spring alloy which would optimize a heat treatment process so as to provide two different stages of alloy which exhibit maximum differences in yield strength, percentage of elongation, and tensile strength.

The relative heat treatability or hardening of a specific 10 or 14 karat alloy composition can first be estimated by use of the silver to silver plus copper ratio formula: (A. S. McDonald & G. H. Sistare, The Metallurgy of Some Carat Gold Alloys, Gold Bulletin, Nov. 1, Volume 11, 1978, pages 66 through 73)

$$\frac{\text{Ag }\%}{\text{Ag }\% + \text{Cu }\%} \times 100\% = \text{Ratio }\%$$

A ratio of 15% for a given alloy is considered marginally heat treatable.

If a particular gold alloy incorporates greater than a 5 weight percent of zinc, the effect is to decrease the hardenability of the alloy, specifically by reducing the immiscibility gap. In the past, gold alloys have incorporated more than 5% zinc and have had heat treatability ratios lower than 25%. These gold alloys have been limited in their ability to be easily worked into proper shape at one stage, while still providing sufficient yield strength in final form so as to provide an alloy suitable for the manufacture of springs and clasps.

An example of the limited gold alloys of the prior art is found in U.S. Pat. No. 2,169,592, which discloses a gold alloy intended to be utilized in the fabrication of jewelry. As stated in line 12 of column 4, the zinc content can reach 12 percent by weight, well above the 5% limit above which heat treatability of a gold alloy is adversely affected. At column 4, line 25 a copper weight percent of 40.45 and a silver weight percent of 7.67 are disclosed. Utilizing the silver to silver copper ratio illustrated above, the ratio can be calculated as:

$$\frac{\text{Ag }\%}{\text{Ag }\% + \text{Cu }\%} \times 100\% = \frac{7.67}{7.67 + 40.40} \times 100\% = 14.94\%$$

15.94%, as explained above would suggest a marginally heat treatable gold alloy composition. Further, the specific example illustrated also incorporates 8.71% zinc, which further limits the hardenability of the gold alloy.

U.S. Pat. No. 2,071,216 relates to the heat treatment and production of precious metal alloys. This patent is particularly concerned with the heat treatment of alloys containing platinum and palladium as well as gold.

U.S. Pat. No. 3,141,799 discloses a heat treatment technique which is commonly used in the gold products industry. This technique improves alloy hardness simply by modifying gold content and is not concerned with the balance of the alloys constituent elements. In addition, this patent discloses that more than 5% zinc is acceptable in a heat treatable gold spring alloy composition.

The above references do not disclose, nor has there been available, a gold alloy composition specifically designed to maximize a specific two step heat treatment process so as to provide a highly ductile alloy after a first step, and after a second step, excellent hardness and resistance to deformation suitable for use in the manufacture of applications requiring high strength and resiliency, such as springs and clasps.

SUMMARY OF THE INVENTION

The present invention relates to a new gold spring alloy coupled with a specific heat treatment process that optimizes the ductility of a solution treated alloy, and the hardness and resistance to deformation of the solution treated alloy after being subjected to an age hardening process. The new improved gold spring alloy consists essentially of about 52 to 64 percent weight gold, 9 to 15 weight percent silver, 20 to 27 weight percent copper, 1 to 5 weight percent zinc, 1 to 5 weight percent nickel and 0.1 to 0.7 weight percent cobalt.

The heat treatment process to which the new improved gold spring alloy is exposed is a two step process. The first step, a solution treatment, yields a highly workable highly ductile alloy with a decreased yield strength and an increased percentage of elongation. The second step, an age hardening treatment, significantly increases yield strength and tensile strength while minimizing the alloy's percentage of elongation; thus a highly stable, deformation resisting alloy results from age hardening.

In the two step heat treatment process, a first step comprises subjecting the new gold spring alloy to a temperature of from about 1200 to 1400 degrees Fahrenheit for about ½ to 2, and preferably 1 hour, in the presence of between about 5 and 25%, preferably 10% of a forming gas or other atmosphere suitable to prevent excessive oxidation, followed by a water quench. A second step provides age hardening of the solution treated alloy by heating the solution treated alloy to a temperature of from about 500 to 700 degrees Fahrenheit in the presence of a forming gas, or an atmosphere suitable to prevent excessive oxidation, for a period of about 1 to 6, and preferably, about 2 to 4 hours. The improved gold spring alloy coupled with the heat treatment process results in an alloy and process that is ideal for the fabrication of springs and clasps as a highly workable stage, followed by a deformation resisting stage is made possible.

The gold spring alloy of the invention has a silver to silver plus copper ratio of greater than about 25 percent.

$$\frac{Ag\ \%}{Ag\ \% + Cu\ \%} \times 100\% > 25\%$$

More preferably, this ratio should be above about 30%.

It has been surprisingly found that utilizing the specifically formulated alloy of the present invention dramatically improves the heat treatability of the gold alloy as compared to heat treatable alloys of the past providing the same silver to silver plus copper ratio. Therefore the gold spring alloy has excellent heat treatability or hardenability as compared to the gold spring alloys presently available.

The zinc component of the present invention is utilized as an anti-oxidizing agent, and is limited to a maximum of about 5 weight percent. Zinc levels above this weight tend to detrimentally affect hardenability by limiting the immiscibility gap. Cobalt at a range of about 0.1 to 0.7 percent, and nickel at a range of about 1 to 5 percent are utilized in the present invention to act as grain refiners to further improve the workability of the alloy. It is believed that the surprisingly enhanced heat treatability of the new gold spring alloy is especially effected by the inclusion of nickel in the formulation.

DESCRIPTION OF THE PREFERRED EMBODIMENTS

The gold spring alloy optimizes the heat treatment process in part by achieving favorable silver to silver plus copper weight percent ratios. As noted above, the relative heat treatability of the alloy can be estimated by use of the hardenability ratio, as follows:

$$\frac{Ag\ \%}{Ag\ \% + Cu\ \%} \times 100\% = \text{Ratio.}$$

A ratio of 15 percent would be considered marginally heat-treatable. In accordance with the present invention, ratios of 25% or better are needed for the subject gold spring alloy.

Optimizing the silver to sliver plus copper ratio in order to improve heat treatability of a gold alloy is known. Now it has been discovered that by specifically formulating a gold alloy to optimize the heat treatment process, a gold spring alloy exhibiting remarkably improved synergism with such treatment is possible as compared to gold spring alloys demonstrating equal silver to silver plus copper ratios. It is believed, but applicant is not to be limited to the theory that the from about 1 to 5 weight percent of nickel present in the gold alloy of the present invention especially improves this synergistic effect.

Figure 1:
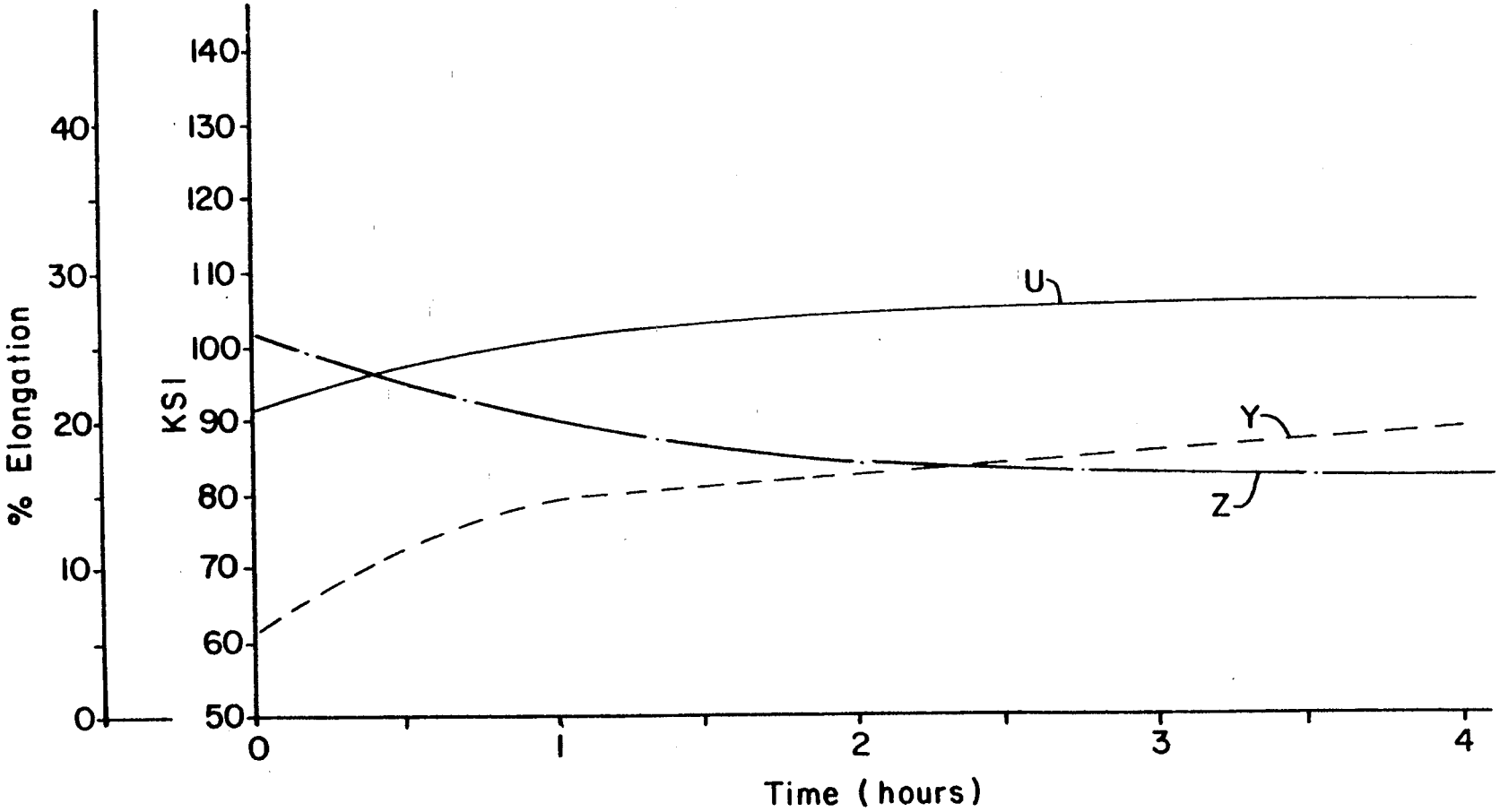
FIG. 1 illustrates the results of subjecting a solution treated improved gold spring alloy to an age hardening temperature of 400 degrees Fahrenheit over a four hour period. U refers to U.T.S. or the ultimate tensile strength of the treated alloy in pounds per square inch. Y refers to Y.S. or yield strength also in pounds per square inch. Z refers to percentage of elongation/2" gauge length.
Figure 2:
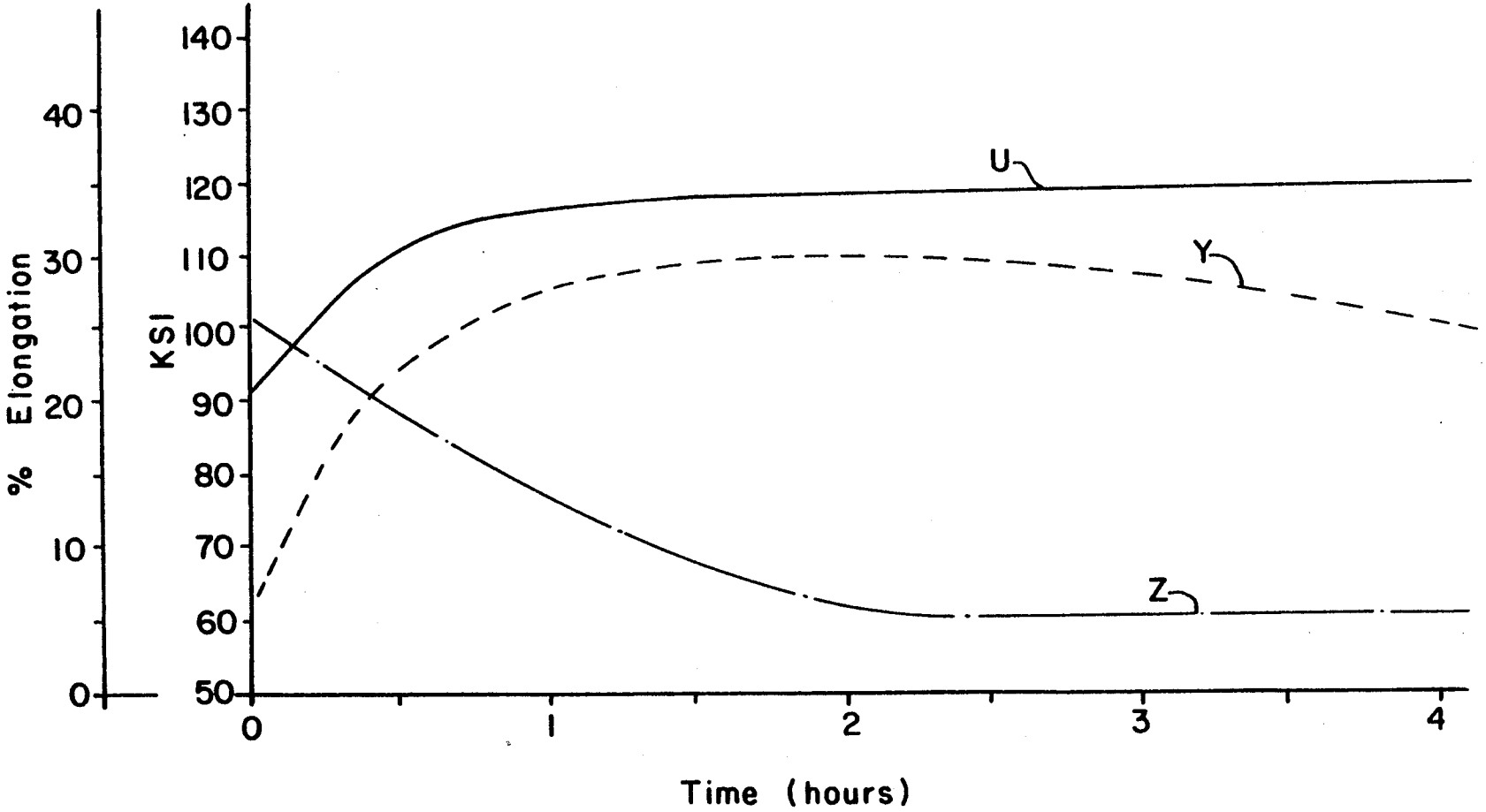
FIG. 2 illustrates the same age hardening heat treatment as FIG. 1, but at a temperature of 500 degrees Fahrenheit.
Figure 3:
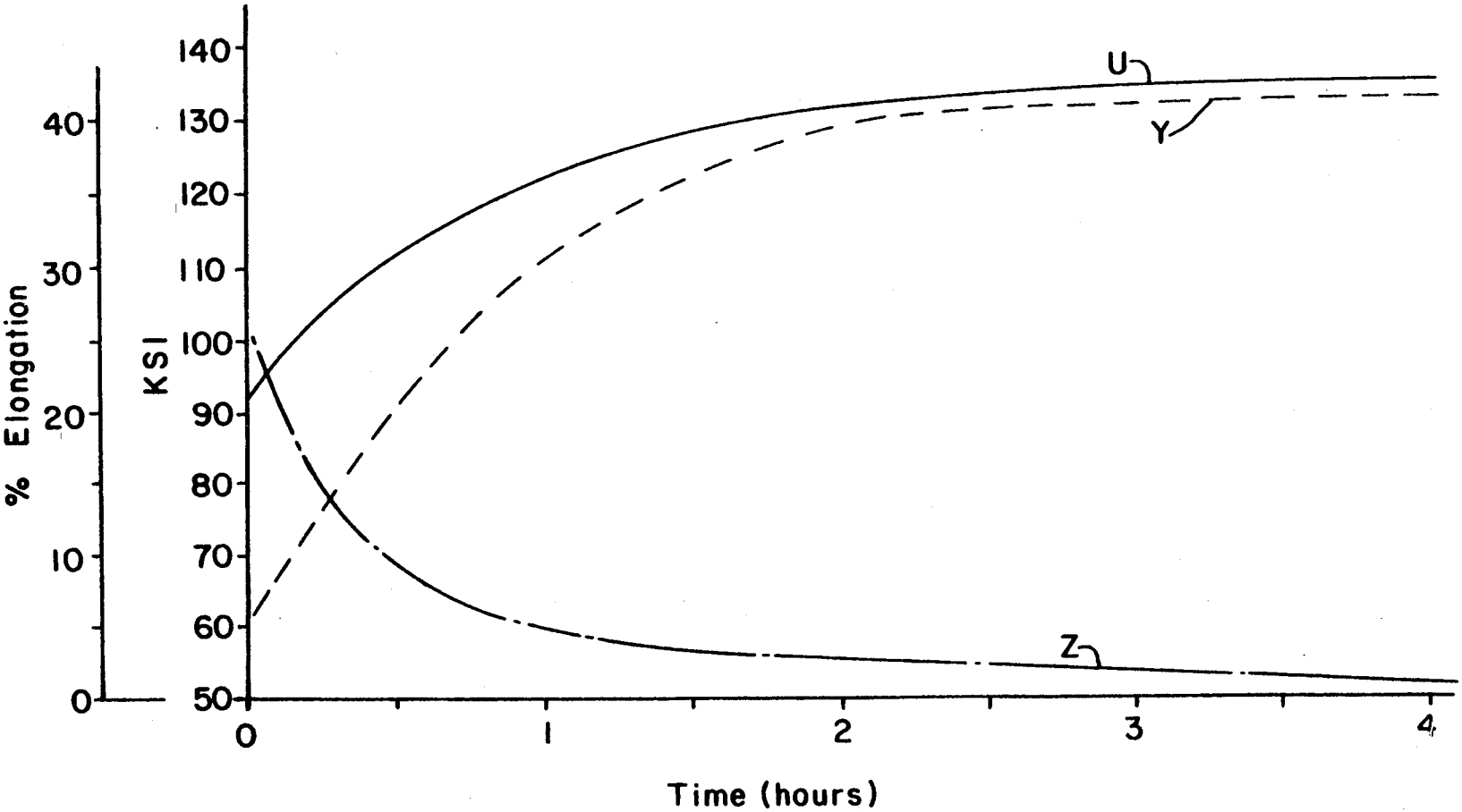
FIG. 3 illustrates the same age hardening heat treatment as FIG. 1, but at a temperature of 600 degrees Fahrenheit.
Figure 4:
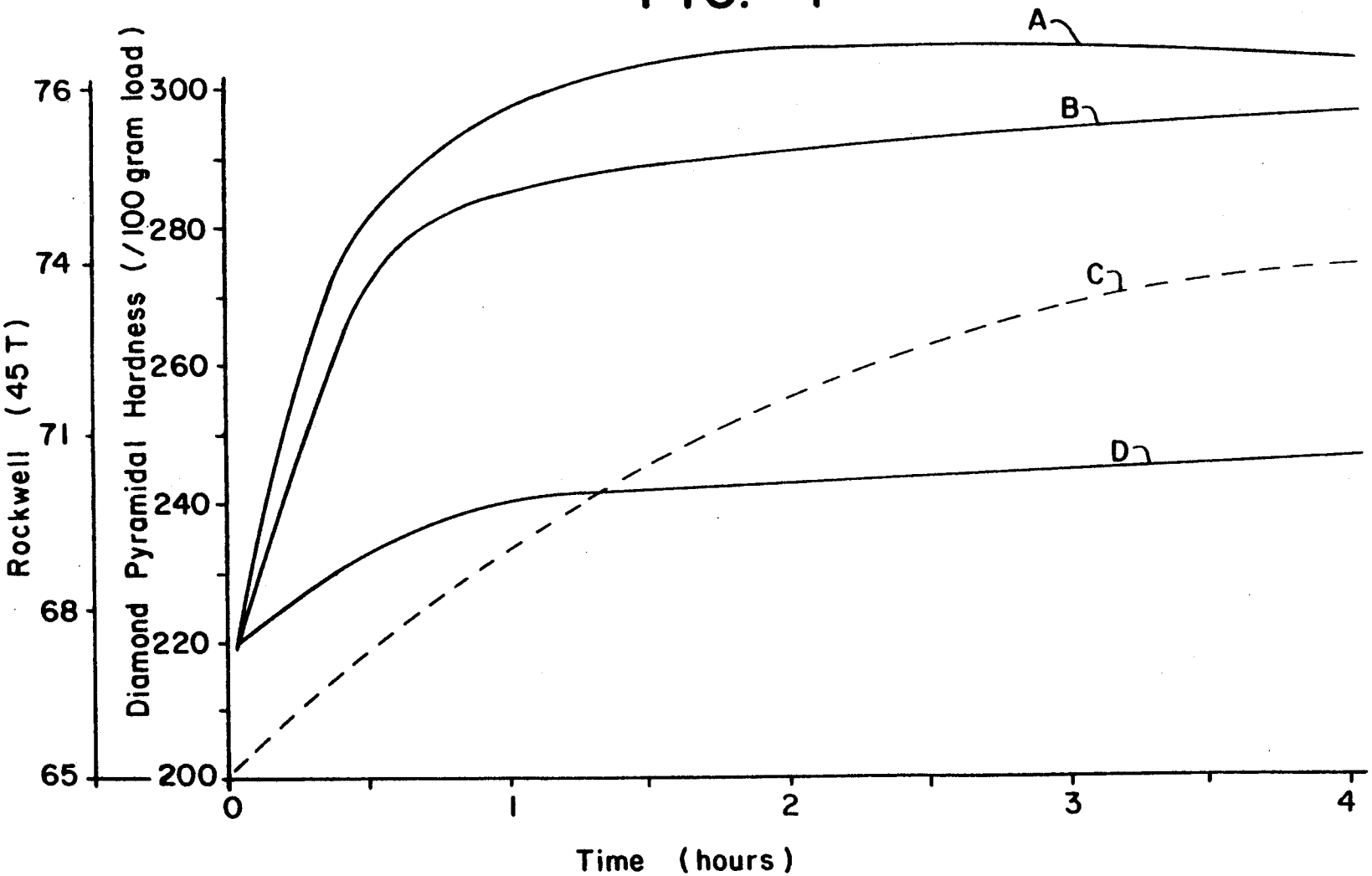
FIG. 4 illustrates DPH (100 gm load) or diamond pyramidal hardness and the optimizing effect in utilizing a 600° F. age hardening temperature illustrated by line A, a 500° F. temperature illustrated by line B and a 400° F. temperature illustrated by line D. The dashed line labeled C illustrates the diminished age hardening response of another 14 kt yellow gold age hardened at 600° F. which can, and has been used as spring material.

FIG. 4 illustrates a comparison between the results achieved in the 600° F. age hardening a gold alloy of the prior art represented by the dashed line labeled C, and an example of the gold spring alloy of the present invention represented by the solid line labeled A. The composition of the prior art gold alloy is:

| Au | Ag | Cu | Zn | Other |
|---|---|---|---|---|
| 58.484 | 12.19 | 24.346 | 4.6 | .38 Co |

This 14 kt yellow gold has a heat treatability ratio of 33.36.

The composition of the present invention is:

| Au | Ag | Cu | Zn | Other |
|---|---|---|---|---|
| 58.484 | 11.86 | 23.676 | 2.6 | 3 Ni.<br>.38 Co |

The 14 kt yellow gold alloy of the present invention has a heat treatability ratio of 33.37. The heat treatability ratio of these alloys is substantially the same, but, as evident by FIG. 4, the heat treatability of the example of the present invention is significantly superior as compared to the prior art gold spring alloy.

EXAMPLE

As an example, but in no way restricting the scope of the present invention, a gold spring alloy consisting essentially of 58.484 weight percent gold, 11.86 weight percent silver, 23.676 weight percent copper, 2.6 weight percent zinc, 3 weight percent nickel, and 0.38 weight percent copper was formulated.

Utilizing the heat treatability ratio formula discussed above, we calculate the resultant ratio as follows:

$$\frac{Ag}{Ag + Cu} \times 100\% = \frac{11.86}{11.86 + 23.676} \times 100\% = 33.37\%$$

If this particular example of the present invention is solution treated at 1300 degrees Fahrenheit for one hour in Forming gas, or other atmosphere suitable to prevent oxidation, the alloy will exhibit the following properties.

| Ultimate Tensile Strength P.S.I. | .2% Offset Yield Strength P.S.I. | % Elongation 2" Gauge Length | DPH 100 gm load |
|---|---|---|---|
| 92,100 | 61,500 | 26 | 220 |

The example inventive alloy, as these figures disclose, is highly ductile and workable after the solution treatment. The alloy is next age hardened at 600 degrees Fahrenheit in forming gas or other atmosphere suitable atmosphere to prevent excessive oxidation for four hours. After age hardening the example alloy will exhibit the following properties:

| Ultimate Tensile Strength P.S.I. | .2% Offset Yield Strength P.S.I. | % Elongation 2" Gauge Length | DPH 100 gm load |
|---|---|---|---|
| 136,000 | 133,200 | 1 | 305 |

As is made apparent by examining these figures, the impressive changes in yield strength and percentage of elongation underline the inventions ability to exhibit vast changes in ductility. The impressive increases in tensile strength and DPH demonstrate a vast change in overall resistance to fracture and hardness.

An optimized gold alloy/heat treatment synergism is disclosed in the present invention. It is now possible to attain in a gold spring alloy greater variations in physical properties heretofore not possible in alloys demonstrating equal silver/silver plus copper ratios. A gold spring alloy is now provided that optimizes a specific heat treatment process so as to provide an extremely formable stage, and, after the alloy is worked into a desired shape, a resilient and durable stage. This gold spring alloy is especially suitable for the manufacture of springs, clasps and other applications where a two stage alloy is desirable.

Having set forth the general nature and the specific embodiments of the present invention, the true scope is now particularly pointed out in the appended claims.

What is claimed is:

1. A gold spring alloy consisting essentially of about 52 to 64 weight percent gold, about 9 to 15 weight percent silver, about 20 to 27 weight percent copper, about 1 to 5 percent zinc, about 1 to 5 weight percent nickel and about 0.1 to 0.7 weight percent cobalt; said gold spring alloy having been formed by a two step heat treatment process, said process including a solution treatment first step comprising treating said alloy in a non-oxidizing atmosphere at a sufficient temperature for a sufficient time to place substantially all alloying elements in solution and thereafter quenching said alloy to provide a formable alloy, and, after the formable alloy is worked into a desired shape, subjecting said alloy to an age hardening second step comprising heating said alloy in a non-oxidizing atmosphere at a sufficient temperature for a sufficient time to provide a gold spring alloy having a resilient and durable second stage and a superior heat treatability as compared to conventional gold alloys having the same heat treatability ratio.

2. The gold spring alloy of claim 1 consisting essentially of about 57 to 60 weight percent gold, about 10 to 14 weight percent silver, about 23 to 25 weight percent copper, about 2 to 3 weight percent zinc, about 2 to 4 weight percent nickel, and about 0.25 to 0.5 weight percent cobalt.

3. The gold spring alloy of claim 1 consisting essentially of about 58.484 weight percent gold, about 11.86 weight percent silver, about 23.676 weight percent copper, about 2.6 weight percent zinc, about 3 weight percent nickel, and about 0.38 weight percent cobalt.

4. The gold spring alloy of claim 1 in which:

$$\frac{Ag\ \%}{Ag\ \% + Cu\ \%} \times 100$$

is greater than about 25 percent, wherein % is weight percent.

5. The gold spring alloy of claim 1 in which:

$$\frac{Ag\ \%}{Ag\ \% + Cu\ \%} \times 100$$

is greater than about 30 percent, wherein % is weight percent.

6. The gold spring alloy of claim 1 in which:

$$\frac{Ag\ \%}{Ag\ \% + Cu\ \%} \times 100$$

is greater than about 33.37 percent, wherein % is weight percent.

7. A gold spring alloy consisting essentially of about 52 to 64 weight percent gold, about 9 to 15 weight percent silver, about 20 to 27 weight percent copper, about 1 to 5 weight percent zinc, about 1 to 5 weight percent nickel and about 0.1 to 0.7 weight percent cobalt; said gold spring alloy having been formed by a two step heat treatment process comprising a solution treatment first step and an age hardening second step, wherein:

a. the solution treatment first step includes heating the gold spring alloy to a temperature of about 1200 to 1400 degrees Fahrenheit in the presence of an atmosphere suitable to prevent excessive oxidation, directly followed by quenching the heated alloy in water to provide a solution treated alloy exhibiting a substantial decrease in yield strength while additionally demonstrating an increased percentage of elongation whereby a highly ductile, highly workable alloy is provided as the first stage; and b. the age hardening second step includes heating the solution treated alloy, after manipulation of said alloy, to a temperature of about 500 to 700 degrees Fahrenheit for two to four hours in the presence of an atmosphere suitable to prevent excessive oxidation to provide an age hardened alloy having increased yield and tensile strengths, and resistance to permanent deformation, whereby the alloy formed as the second stage is suitable for use as a clasp or spring.

8. The gold spring alloy of claim 7 wherein:

a. the solution treatment first step includes heating the gold spring alloy to a temperature of about 1300 degrees Fahrenheit in the presence of an atmosphere suitable to prevent excessive oxidation, directly followed by quenching the heated alloy in water to provide a solution treated alloy exhibiting a substantial decrease in yield strength while additionally demonstrating an increased percentage of elongation whereby a highly ductile, highly workable alloy is provided as the first stage; and b. the age hardening second step includes heating the solution treated alloy, after manipulation of said alloy, to a temperature of about 600 degrees Fahrenheit in the presence of an atmosphere suitable to prevent excessive oxidation for a period of two to four hours to provide an alloy having increased yield and tensile strengths, and resistance to permanent deformation whereby the age hardened alloy formed as the second stage is suitable for use as a clasp or spring.

9. The gold spring alloy of claim 1 wherein the non-oxidizing atmosphere is forming gas.

10. The gold spring alloy of claim 1 wherein the forming gas is comprised of a hydrogen/nitrogen mixture of about 5 to 10 weight percent hydrogen providing a slightly reducing or non-oxidizing atmosphere.

11. The gold spring alloy of claim 1 wherein the alloy is solution treated at a temperature of about 1200 to 1400 degrees Fahrenheit for about ½ to 2 hours.

12. The gold spring alloy of claim 1 wherein the alloy is solution treated for about one hour at about 1300 F.

13. The gold spring alloy of claim 1 wherein the alloy is quenched in water.

14. The gold spring alloy of claim 1 wherein the alloy is age hardened at a temperature of about 500 to 700 degrees Fahrenheit for about 1 to 6 hours.

15. The gold spring alloy of claim 1 wherein the alloy is age hardened for about 2 to 4 hours at about 600 F.

16. The gold spring alloy of claim 1 wherein said alloy is heated to a temperature of about 1200 to 1400 degrees Fahrenheit and thereafter quenched in said solution treatment first step and wherein said solution treated alloy is thereafter heated to a temperature of about 500 to 700 degrees Fahrenheit temperature in said age hardening step.

* * * * *